US007984845B2

(12) United States Patent
Kelly

(10) Patent No.: US 7,984,845 B2
(45) Date of Patent: Jul. 26, 2011

(54) REGULATED FLUID DISPENSING SYSTEM PACKAGING

(75) Inventor: Jason Morgan Kelly, Arvada, CO (US)

(73) Assignee: MillerCoors, LLC, Golden, CO (US)

( * ) Notice: Subject to any disclaimer, the term of this patent is extended or adjusted under 35 U.S.C. 154(b) by 252 days.

(21) Appl. No.: 12/128,389

(22) Filed: May 28, 2008

(65) Prior Publication Data

US 2009/0283579 A1 Nov. 19, 2009

Related U.S. Application Data

(63) Continuation-in-part of application No. 12/123,262, filed on May 19, 2008.

(51) Int. Cl.
*B65D 17/28* (2006.01)
*B67D 7/72* (2010.01)

(52) U.S. Cl. ..... 229/242; 222/105; 222/107; 222/540

(58) Field of Classification Search ..... 229/117.13, 229/117.16, 241, 242; 222/105, 107, 540
See application file for complete search history.

(56) References Cited

U.S. PATENT DOCUMENTS

| | | | | |
|---|---|---|---|---|
| 1,832,587 | A | 11/1931 | Schneible | |
| 1,832,589 | A | 11/1931 | Snograss | |
| 2,547,892 | A * | 4/1951 | Stevens | 206/449 |
| 2,569,378 | A | 9/1951 | Hood | |
| 3,160,326 | A * | 12/1964 | Sturdevant et al. | 229/117.13 |
| 3,246,825 | A * | 4/1966 | Zastrow | 229/117.16 |
| 3,349,959 | A * | 10/1967 | Watkins | 229/131.1 |
| 3,349,986 | A * | 10/1967 | Chapman et al. | 229/117.13 |
| 3,478,929 | A | 11/1969 | Cornelius et al. | |
| 3,756,471 | A * | 9/1973 | Wissman | 229/242 |
| 4,265,374 | A | 5/1981 | Sebalos | |
| 4,482,509 | A | 11/1984 | Iannelli | |
| 4,610,888 | A | 9/1986 | Teng et al. | |
| 4,696,840 | A | 9/1987 | McCullough et al. | |
| 4,793,515 | A | 12/1988 | Shannon et al. | |
| 4,955,512 | A | 9/1990 | Sharples | |
| 4,979,641 | A | 12/1990 | Turner | |
| 4,995,945 | A | 2/1991 | Craig | |
| 5,022,565 | A | 6/1991 | Sturman et al. | |
| D325,344 | S | 4/1992 | Scholle | |
| 5,106,015 | A * | 4/1992 | Vlasaty et al. | 222/540 |
| 5,111,970 | A | 5/1992 | Rutter et al. | |
| 5,115,626 | A | 5/1992 | Rutter et al. | |

(Continued)

FOREIGN PATENT DOCUMENTS

CA 2355267 6/2000

(Continued)

OTHER PUBLICATIONS

U.S. Appl. No. 12/255,230, filed Oct. 21, 2008, Kelly et al.

(Continued)

*Primary Examiner* — Gary E Elkins
(74) *Attorney, Agent, or Firm* — Sheridan Ross, P.C.

(57) ABSTRACT

A packaging container is used to package a regulated fluid dispensing system including a regulated fluid dispensing device and a beverage container. The packaging includes carry handles, and a perforation pattern that allows a front panel of the packaging container to be removed thus exposing working parts of the dispensing device. The dispensing system may remain housed within the packaging during use that assists in stabilizing and protecting the dispensing system.

2 Claims, 4 Drawing Sheets

U.S. PATENT DOCUMENTS

| | | | | |
|---|---|---|---|---|
| 5,115,841 | A | 5/1992 | Horino et al. | |
| 5,139,708 | A | 8/1992 | Scott | |
| 5,147,071 | A | 9/1992 | Rutter et al. | |
| 5,203,470 | A | 4/1993 | Brown | |
| 5,329,975 | A | 7/1994 | Heitel | |
| 5,395,012 | A | 3/1995 | Grill | |
| 5,396,934 | A | 3/1995 | Moench | |
| 5,443,186 | A | 8/1995 | Grill | |
| 5,458,165 | A | 10/1995 | Liebmann, Jr. | |
| 5,487,850 | A | 1/1996 | Vanderploeg | |
| 5,551,600 | A | 9/1996 | Sasaki et al. | |
| 5,565,149 | A | 10/1996 | Page et al. | |
| 5,750,216 | A | 5/1998 | Horino et al. | |
| 5,788,121 | A | 8/1998 | Sasaki et al. | |
| 5,826,752 | A * | 10/1998 | Latimer | 222/105 |
| 5,925,563 | A | 7/1999 | Redford | |
| 5,979,713 | A | 11/1999 | Grill | |
| 6,036,054 | A | 3/2000 | Grill | |
| 6,045,036 | A * | 4/2000 | Ring | 229/117.13 |
| 6,116,467 | A | 9/2000 | Petriekis et al. | |
| 6,138,995 | A | 10/2000 | Page | |
| 6,321,948 | B1 | 11/2001 | Bellon et al. | |
| 6,355,292 | B1 | 3/2002 | Cheng et al. | |
| 6,595,391 | B1 | 7/2003 | Anderson et al. | |
| 6,609,636 | B1 | 8/2003 | Petriekis et al. | |
| 6,612,545 | B1 | 9/2003 | Rutter et al. | |
| 6,637,623 | B2 * | 10/2003 | Muise et al. | 222/105 |
| 6,702,337 | B2 | 3/2004 | Rutter et al. | |
| 6,802,341 | B1 | 10/2004 | Johnson et al. | |
| 6,827,237 | B2 | 12/2004 | Yorn et al. | |
| 6,880,797 | B2 | 4/2005 | Yui | |
| 6,893,000 | B2 | 5/2005 | Rutter et al. | |
| 6,942,123 | B2 | 9/2005 | Wertenberger | |
| 6,971,548 | B2 | 12/2005 | Smith | |
| 7,032,781 | B2 | 4/2006 | Van Der Klaauw et al. | |
| 7,137,538 | B2 | 11/2006 | Wright | |
| 7,150,377 | B2 | 12/2006 | Cook et al. | |
| 7,389,909 | B2 * | 6/2008 | Crosland et al. | 229/242 |
| 2003/0024950 | A1 | 2/2003 | Yoneyama et al. | |
| 2005/0150939 | A1 * | 7/2005 | Fakes et al. | 229/235 |
| 2006/0071021 | A1 | 4/2006 | Steeves et al. | |
| 2006/0097005 | A1 | 5/2006 | Hill et al. | |
| 2006/0118574 | A1 | 6/2006 | Anderson et al. | |
| 2006/0169725 | A1 | 8/2006 | Grill | |
| 2006/0243783 | A1 * | 11/2006 | Spivey et al. | 229/242 |

FOREIGN PATENT DOCUMENTS

| | | | |
|---|---|---|---|
| CA | 2596916 | | 8/2006 |
| EP | 0132340 | | 7/1984 |
| EP | 0276994 | | 1/1988 |
| EP | 361042 | A1 * | 4/1990 |
| EP | 0683224 | | 11/1995 |
| EP | 0732142 | | 9/1996 |
| EP | 1094027 | | 4/2001 |
| JP | 2019276 | | 1/1990 |
| JP | 9169359 | | 6/1997 |
| JP | 2001/048298 | | 2/2001 |
| JP | 2002347837 | | 12/2002 |
| KR | 930001695 | | 3/1993 |
| WO | WO 89/00544 | | 1/1989 |
| WO | WO2005047171 | A1 | 5/2001 |
| WO | WO0158802 | | 8/2001 |
| WO | WO2006096510 | | 9/2006 |

OTHER PUBLICATIONS

U.S. Appl. No. 12/389,164, filed Feb. 19, 2009, Kelly et al.

U.S. Appl. No. 12/123,262, filed May 19, 2008, Kelly et al.

"Bag-in-Box-idea", available at http://www.ankerbrauerei.de/ankerbrauerei/e/dieidee.htm, printed Mar. 26, 2007.

International Search Report for International (PCT) Patent Application No. PCT/US08/86342, mailed Feb. 12, 2009.

Written Opinion for International (PCT) Patent Application No. PCT/US08/86342, mailed Feb. 12, 2009.

SBG-TAP-A-Draft, How It Works, Available at http://www.sturmanbg.com/products/beverape.dispenser.asp, Dated Apr. 15, 2007, p. 1 of 1.

Sturman BG, LLC, TAP-A-Draft, Beverage Dispensing Unit, Operating Instructions, 3 pages.

Advertisement: RAPAK, Bag-In-Box Beer, Bag-in-Box innovation for beer, The "Beer Keg" of the future, available at www.rapak.com, Mar. 27, 2007, pp. 2.

Advertisement: Rapak-Bag-in-Box for Beer: Commercial Solutions, available at http://www.rapak.com/beer-commercial.asp, 1 page.

Advertisement: Ankerbrau Nordlingen—Geniefß' das Ries!, Bag-in-Box-ideas, available at http://www.ankerbrauerei.de/ankerbrauerei/e/dieidee.htm, Mar. 27, 2007, 1 page.

* cited by examiner

REGULATED FLUID DISPENSING SYSTEM PACKAGING

FIELD OF THE INVENTION

The present invention relates to packaging for products, and more particularly, to a packaging container for a regulated fluid dispensing system wherein the packaging container is configured to expose a portion of the dispensing system during use.

BACKGROUND OF THE INVENTION

Paper or cardboard packaging for products remains a common way in which to protect products during shipment and storage. There is an extremely diverse number of packaging designs for products in different industries.

For beverages such as soda or malt beverages, many different packaging designs are available to store and ship such products, as well as to present them for display at retail locations. For larger bulk containers of beverages, such as kegs of beer, because of their size and the nature of the kegs, it is usually unnecessary to provide separate packaging. However, more recently, beverage containers have been developed that are larger than traditional beverage containers, but smaller than containers such as beer kegs. More specifically, in the malt beverage industry, intermediate sized containers have been used to dispense multiple servings of a beverage, such as six liters, therefore eliminating the need for separate single serving containers. These intermediate sized containers may include an integral source of pressurized gas so that the beverages within the containers may be kept at a desired pressure to prevent loss of carbonization.

One example of a regulated fluid dispensing system including the aforementioned intermediate sized container is disclosed in Applicant's co-pending patent application Ser. No. 12/123,262 filed on May 19, 2008, entitled "Regulated Fluid Dispensing Device and Method of Dispensing a Carbonated Beverage", the contents of which are hereby incorporated by reference in its entirety. In this fluid dispensing system, a container is provided that is connected to a pressurized source of gas, and an integral regulator maintains the beverage within the container at a desired pressure. The beverage container may have a cylindrical sidewall. For dispensing a beverage, the beverage container is placed on its side such that the cylindrical sidewall touches the surface upon which the system is mounted.

While traditional packaging may be adequate for standard beverage containers, there is a need to provide special packaging for a regulated fluid dispensing system having an attached container. More specifically, this system requires packaging to store the system, to protect it during shipment, as well as to allow the system to remain within the packaging during use that facilitates dispensing of the beverage when the beverage container is placed on its side.

SUMMARY OF THE INVENTION

In accordance with the present invention, a packaging container or carton is provided that is especially adapted for housing a fluid dispensing system wherein the packaging container can be used to ship and store the system, as well as to allow the system to remain protected within the packaging during use. As discussed in more detail below, the packaging container includes a front panel that may be completely removed, thereby exposing the dispensing tap of the fluid dispensing system. The fluid dispensing system including the attached beverage container can remain within the packaging container, thereby providing a stable support for the beverage container such that it does not have a tendency to roll or shift during use. Breakaway flaps are also formed on upper and lower panels of the packaging container, which further assist the user in accessing the working parts of the dispensing system. More specifically, the breakaway flap on the top panel eases access to the tap handle, while the breakaway flap on the bottom or lower panel eases access to the removable cartridge housing which holds a cartridge containing a pressurized gas. Carry handles are also incorporated on the packaging, which enables a user to easily grasp the packaging for movement or transport of the fluid dispensing system.

In one aspect of the invention, it may be considered a packaging container. In another aspect of the invention, it may be considered a combination of a packaging device along with a regulated fluid dispensing system. Various other features and advantages will become apparent from a review of the following detailed description, taken in conjunction with the drawings.

DETAILED DESCRIPTION

Figure 2:
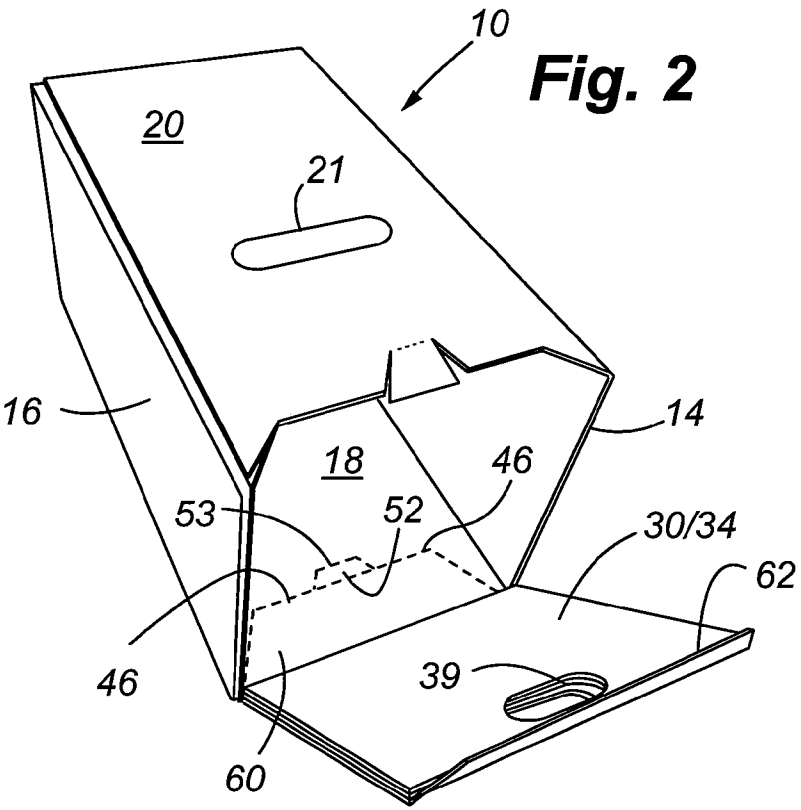
FIG. 2 is a partially exploded perspective view of the packaging illustrating the front panel being removed from the packaging along the top panel and side panels.
Figure 1:
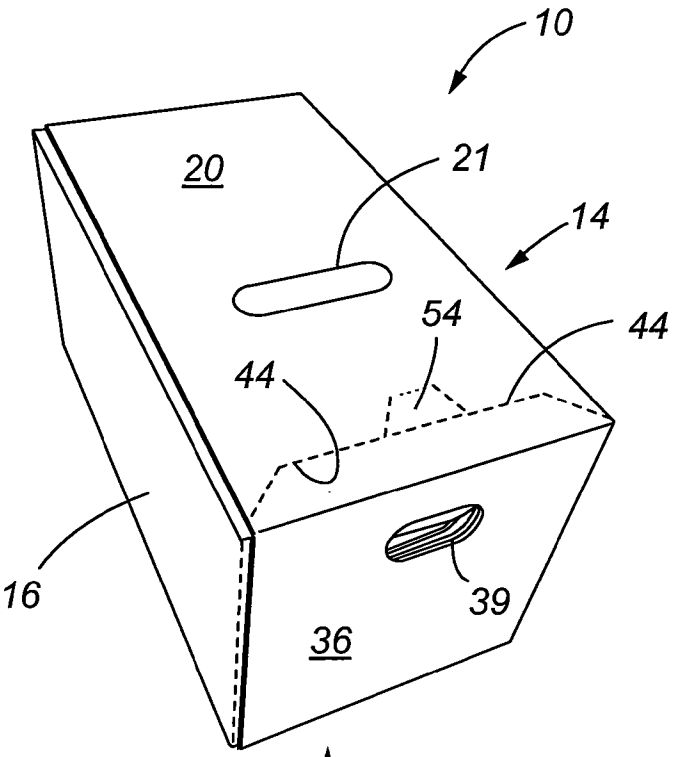
FIG. 1 is a perspective view of the regulated fluid dispensing system packaging container of the present invention.

Referring to FIGS. 1 and 2, the packaging container 10 of the present invention is illustrated. The exterior surface of the packaging is defined by an outer top panel 20, an opposed bottom panel 18, and an opposed pair of side panels, shown as first side panel 14 and second side panel 16.

Figure 5:
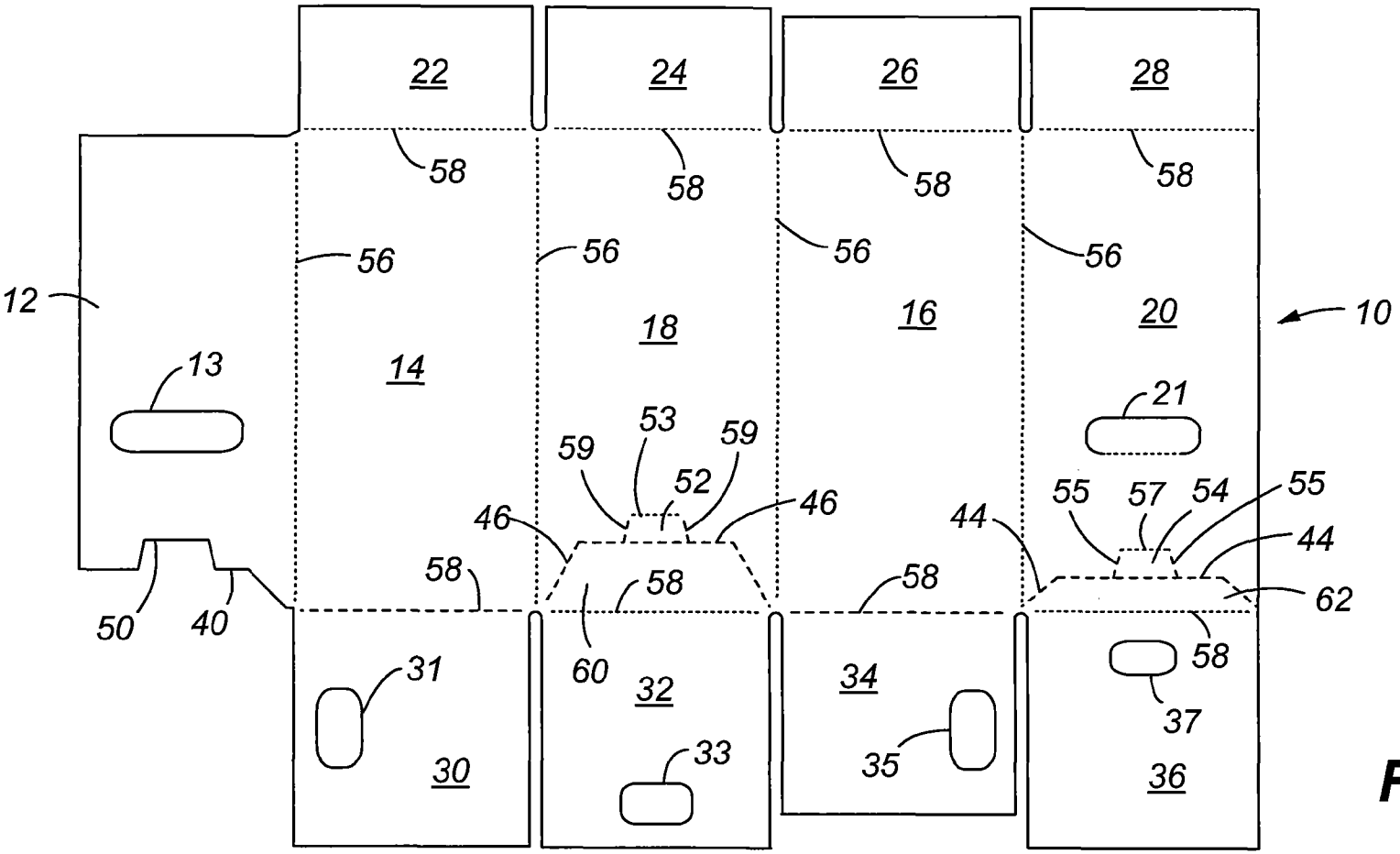
FIG. 5 is a plan view of the packaging blank illustrating the various features of the packaging container including the panels, flaps, fold lines, perforations, and openings in the blank.

Referring also to FIG. 5, the plan view of the packaging container 10 illustrates each of the panels and flaps of the packaging container prior to assembly of the packaging. Referring specifically to this FIG. 5, the packaging 10 further includes an inner top panel 12, which resides under the outer top panel 20 when the packaging is assembled. Slot 13 of the inner panel 12 aligns with the slot 21 formed on the outer top panel 20 to form a top carry opening. The back or rear panel of the packaging includes a plurality of closing flaps, namely, a first rear side closing flap 22, a rear bottom closing flap 24, a second rear side closing flap 26, and a top rear closing flap 28. When the packaging is assembled, the closing flaps close the rear side of the package in a conventional manner wherein pairs of opposing flaps are rotated to close the rear side. The front panel 21 of the packaging also includes a plurality of closing flaps to include first front side closing flap 30, front bottom closing flap 32, second front side closing flap 34, and the front closing flap 36. Top front closing flap 36 includes a top front carry opening 39. Each of the front closing flaps includes corresponding slots that form the front carry opening 39, as well as a means to remove the front panel as discussed further below. These slots include first side slot 31, bottom slot 33, second side slot 35, and top slot 37. When the packaging is folded, the slots 31, 33, 35 and 37 align with one another as shown in FIGS. 1 and 2 to form the front carry opening 39.

FIG. 5 illustrates further details to include the various fold lines 56 and 58 that allow the packaging to be folded in the configuration shown in the figures. As shown, the fold lines delineate the separation between the various panels and flaps. FIG. 5 also illustrates other features of the packaging container to include various perforation lines that delineate additional flaps. More specifically, bottom panel 18 includes perforation line 46 that delineates a bottom breakaway flap 60. A bottom hand pull-tab 52 is defined by (i) a portion of perforation line 46, (ii) fold 53 that is spaced from perforation line 46, and (iii) perforation lines 59 that interconnects fold 53 with perforation line 46. The outer top panel 20 also includes a top breakaway flap 62 defined by perforation line 44. A top hand pull-tab 54 is formed on the top panel 20 as is defined by (i) a portion of perforation line 44, (ii) fold line 57, and (iii) the pair of interconnection perforation lines 55.

Figure 4:
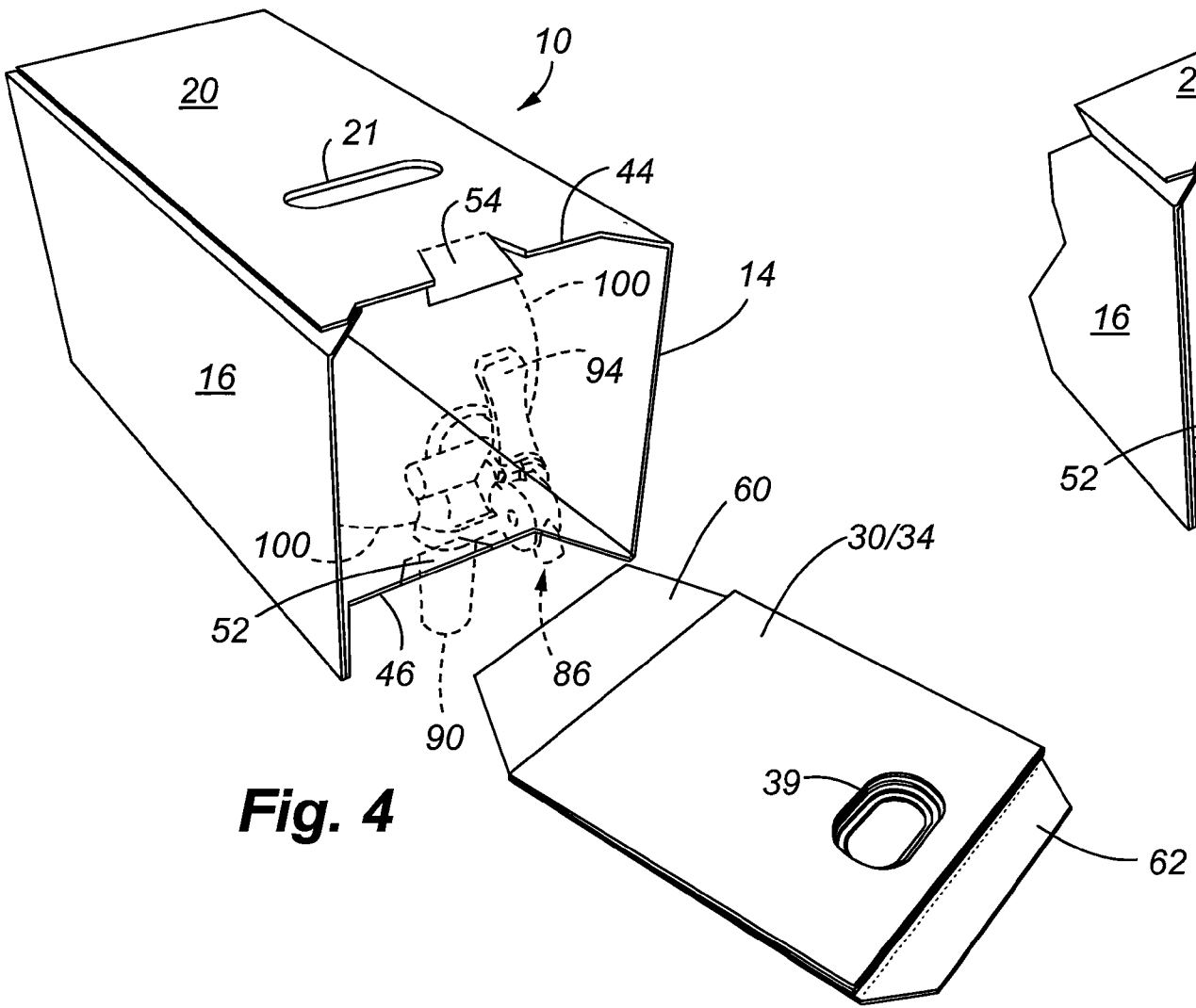
FIG. 4 is an exploded perspective view of the packaging container showing the front panel completely removed from the packaging, and showing the fluid dispensing system housed within the packaging.

Referring to FIGS. 2 and 4, when it is desired to access the interior of the packaging container, the user breaks the portion of the perforation line 44 located at the hand tab 54, and breaks the interconnecting perforations 55 that therefore allow the hand to be inserted within the container. The user can then pull forward on the front panel, thereby separating the front panel such that the interior of the packaging is exposed. As shown in FIG. 2, the breakaway flap 62, when separated from the top panel, forms a slot or notch in the top panel.

Referring to FIG. 5, the inner top panel 12 has a corresponding cutout 40, as well as a slot 50 that underlie the breakaway flap 62. As shown in FIG. 4, if it is desired to completely remove the front panel, the user may break the perforation line 46 at bottom tab 52, and then pull such that the breakaway flap 60 is removed from the bottom panel 18.

Figure 3:
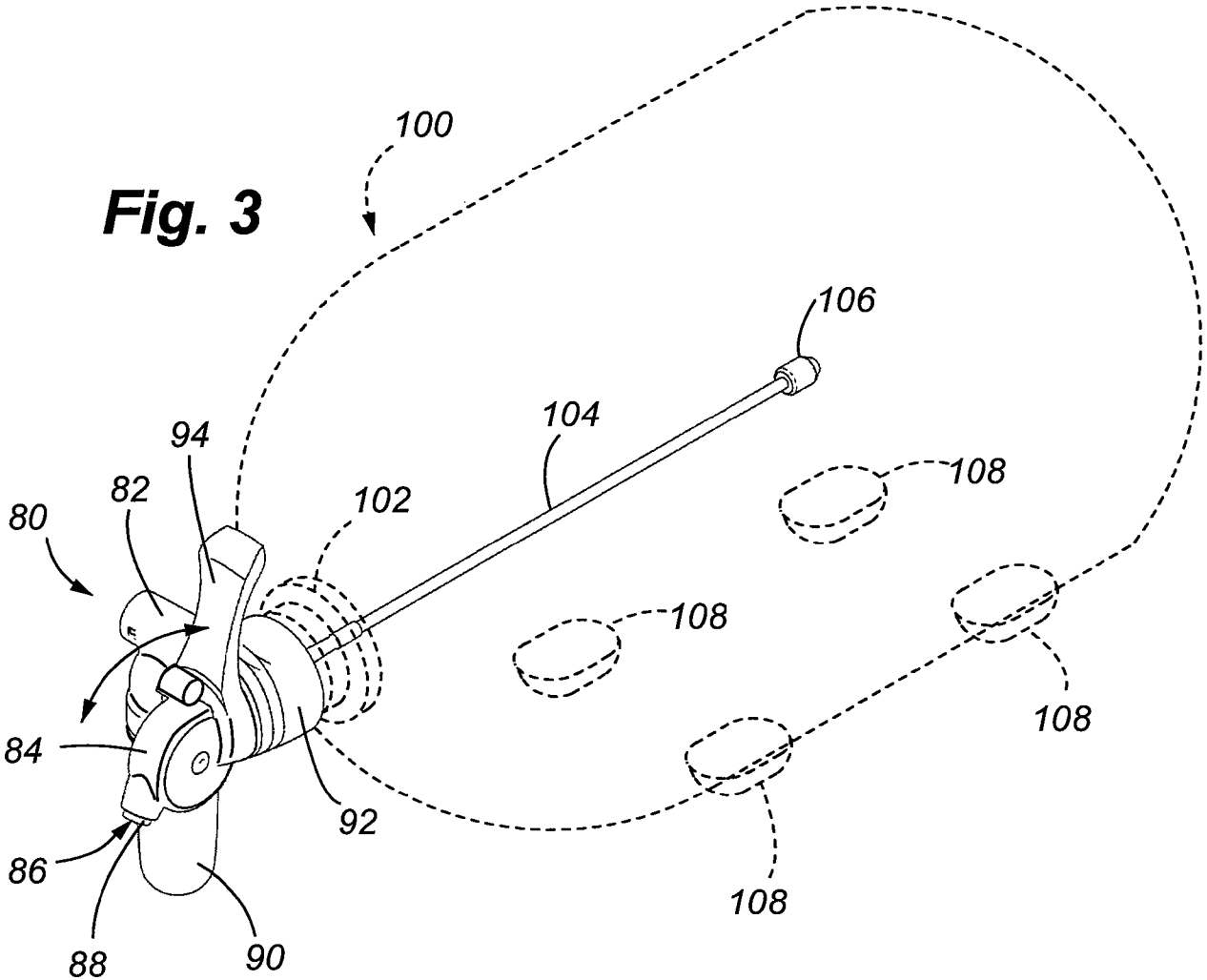
FIG. 3 is a perspective view of an exemplary regulated fluid dispensing system that may be housed by the packaging container of the present invention.

Referring to FIG. 3, an exemplary regulated fluid dispensing system is shown including a beverage container 100 having a cylindrical sidewall, which is connected to a regulated fluid dispensing device 80. The fluid dispensing device 80 generally includes a regulator housing 82, an outlet housing 84, an outlet 86, and an outlet tube 88 that carries the beverage to the outlet. A cartridge housing 90 attaches to the regulator housing 82. The cartridge housing 90 houses a cartridge (not shown) containing a compressed gas, which is used to pressurize the beverage container 100. A connection housing 92 interconnects a threaded neck 102 of the beverage container to the dispensing device 80. A tap handle 94 is used to control the flow of beverage. An inlet tube 104 is used to draw the beverage through the dispensing device to the outlet tube 88. A weighted tip 106 defines the distal or free end of the inlet tube 104. Optionally, a plurality of feet 108 may be made integral with the beverage container sidewall, allowing a more stable surface for the beverage container to rest upon when the dispensing device is in use.

Referring specifically to FIG. 4, the fluid dispensing device 80 and beverage container 100 are shown within the packaging container 10. The dispensing device 80 is exposed allowing a user to conveniently access the working parts of the dispensing device 80. More particularly, the breakaway flaps 60 and 62 when removed from the packaging create gaps that more easily allow the user to gain access to the working parts, such as the tap handle 94, and the cartridge housing 90. Periodically, the compressed gas cartridge must be replaced by unscrewing the cartridge housing and placing a new cartridge in the housing. As shown in FIG. 4, the packaging provides additional support to the dispensing device and beverage container such that the dispensing device and beverage container may be conveniently stored on a horizontal surface such as a shelf.

Figure 6:
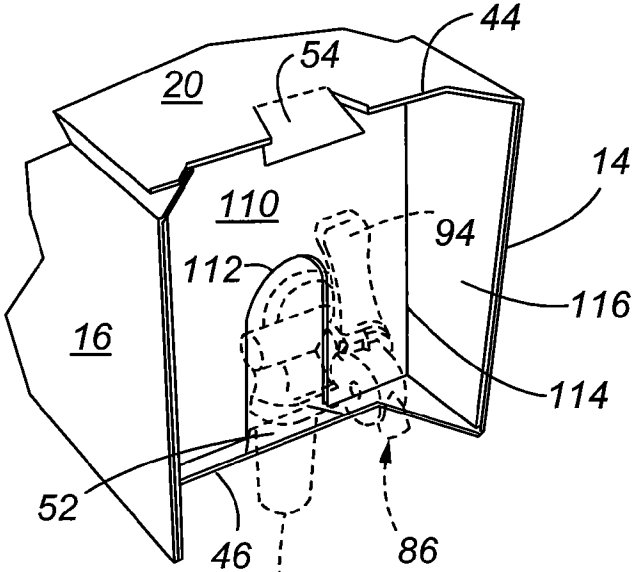
FIG. 6 is another perspective view showing an optional partition used in the packaging.

FIG. 6 illustrates an optional partition 110 that may be used to further stabilize the container within the packaging. As shown, the partition 110 extends across the front portion of the container and a slot 112 allows the fluid dispensing device to remain exposed, while the container is hidden on the opposite side of the partition. Accordingly, the slot 112 is formed to surround the neck of the container. The partition 110 includes a pair of side contacting flaps 116 that make contact with respective interior sidewalls of the container. Folds 114 can be positioned so that the partition 110 fits snuggly within the interior of the packaging.

By the foregoing, packaging is provided for a regulated fluid dispensing device and beverage container wherein the packaging conveniently allows for transport and storage, as well as use of the dispensing device without having to remove the dispensing device from within the packaging. The removable front panel enables access to the interior of the packaging, and to the various working parts of the dispensing device without destroying the basic integrity of the packaging.

Although the foregoing invention has been disclosed with respect to preferred embodiments, it shall be understood that various other changes and modifications can be made commensurate with the scope of the claims appended hereto.

What is claimed:

1. In combination, a packaging container and a fluid dispensing system, comprising:

(i) a container comprising:

a plurality of panels including opposing side panels, a bottom panel, and a top panel, said plurality of panels enclosing an interior open space;

a plurality of rear closing flaps for closing a rear end of said container;

a plurality of front closing flaps for closing a front end of said container;

said top panel includes a top breakaway flap formed on a front portion thereof and defined by a top breakaway perforation line communicating with said front closing flaps, said bottom panel including a bottom breakaway flap formed thereon, and defined by a bottom breakaway perforation line;

(ii) a fluid dispensing system housed in said interior open space, said fluid dispensing system including a beverage container and a regulated fluid dispensing device attached thereto, said fluid dispensing device residing at a front portion of said interior open space, said dispensing device including a regulator housing, a regulator, a tap handle, a connection housing extending angularly from said regulator housing, and a cartridge housing that contains a single cartridge providing a source of pressurized gas controlled by the regulator to selectively pressurize an interior of the beverage container; and (iii) a partition extending across said interior open space and adjacent a front portion of said interior open space, said beverage container residing on one side of said partition and said fluid dispensing system residing on the other side of said partition and exposed when removing the front end of the container.

2. In combination, a packaging container and a fluid dispensing system, comprising:

a container comprising a plurality of panels including opposing side panels, opposing bottom and top panels, said plurality of panels forming a container enclosing an interior open space, and a plurality of front and rear closing flaps for closing corresponding rear and front ends of the container;

a fluid dispensing system housed in the interior open space, the fluid dispensing system including a beverage container having a regulated fluid dispensing device attached thereto, said dispensing device including a regulator, a regulator housing, a tap handle, a connection housing extending away from said regulator housing, and a cartridge housing that contains a single cartridge providing a source of pressurized gas controlled by the regulator to selectively pressurize an interior of the beverage container; and wherein said container further includes opposing breakaway flaps formed on said top and bottom panels, said breakaway flaps each including corresponding breakaway perforation lines such that when said perforation lines are broken, said front end of said container can be removed, thereby exposing the regulated fluid dispensing device.

* * * * *